United States Patent [19]

Rubin

[11] Patent Number: 4,868,998

[45] Date of Patent: Sep. 26, 1989

[54] TUMBLE DRYER

[76] Inventor: Richard H. Rubin, 34 Plein St., Cape Town 8001, South Africa

[21] Appl. No.: 251,128

[22] Filed: Sep. 29, 1988

[51] Int. Cl.[4] ..... F26B 19/00

[52] U.S. Cl. ..... 34/91; 34/133

[58] Field of Search ..... 34/90, 91, 97, 133

[56] References Cited

U.S. PATENT DOCUMENTS 3,157,475 11/1964 Stainbrook ..... 34/90

*Primary Examiner*—Henry A. Bennet

*Attorney, Agent, or Firm*—Ladas & Parry

[57] ABSTRACT

A tumble dryer for small articles of clothing having no motor or heater utilizes the output of a hair dryer to both rotate a drum containing the articles of clothing and to dry the articles. Turbine blades mounted on the periphery of the drum slowly rotate the drum to prevent uneven drying of the clothing in the warm air output from the dryer. A tray mounted beneath the drum can be used to catch water dripping from the clothing. Removing the tray allows the hot air to escape from the bottom of the unit for warming the room or drying hands. The tumble dryer and its associated hair dryer are preferably wall-mounted.

7 Claims, 4 Drawing Sheets

TUMBLE DRYER

BACKGROUND OF THE INVENTION

This invention relates to a tumble dryer for drying small articles of clothing. In particular, it relates to a tumble dryer driven by a wall-mounted hair dryer which is mounted adjacent to the tumble dryer.

Persons living in hotels, boarding houses, aboard ships or the like, often find it convenient to wash small items of clothing such as underwear, stockings and socks in their own room. These items are typically hung up within the room to air dry. They are then faced with the problem that the clothing may not be dry within a reasonable period of time so that they can wear or pack the item. This problem is exacerbated in cold, wet climates.

As an amenity to their quest, proprietors of hotels, boarding houses and ships could provide small, electrically-heated dryers for drying such small articles of clothing in a short period of time. Small, electrically heated dryers are known in the art. U.S. Pat. No. 3,357,109 to Harvey discloses a small portable having a rotating drum basket 30 and an extension duct 58 for hair dryer use. The drum basket 30 is rotated by the same motor that rotates the fan to provide the air flow for both the clothes drying and hairdrying functions. A similar device is shown in U.S. Pat. No. 3,157,475 to Stainbrook.

U.S. Pat. No. 4,199,873 to Hansen et al discloses a foldable pantyhose dryer 10 which is used with a portable hair dryer 30 as a heat source. The dryer consists of a box-like compartment through which hot air may be delivered by a conventional portable hair dryer. The box-like container is designed so that it may be folded to a flat configuration when not in use and may be constructed of cardboard. U.S. Pat. No. 3,892,047 to Muller-Scherak discloses an inflatable bag contoured to the general configuration of a to be dried which is inflated by a portable hair dryer. The flow of hot air from the portable hair dryer dries the garment in the inflated bag. Similarly, U.S. Pat. No. 4,406,071 to Buchanan discloses a foldable garment dryer which is utilized with a conventional hand-held hair dryer and has a flexible bag for holding the garment. Another similar device is shown in the U.S. Pat. No. 3,905,125 to Hubner which shows a collapsible garment dryer which has a foldable bag containing the clothes to be dried and a hot air generator located in the upper section of the bag for directing hot air into the bag for drying the garments.

U.S. Pat. No. 3,577,650 to Brahm discloses a portable and collapsible clothes dryer receptacle which is mounted on a foldable frame and adapted for attachment to a heater-blower unit. The heater-blower unit may be of the type usually associated with portable hair dryer units. U.S. Pat. No. 2,793,444 to Turner discloses a portable clothes dryer which is designed to expand to accommodate a greater load during use.

These known devices are unsuitable for utilization in hotels, boarding houses and aboard ships. All of the devices disclosed in the patents discussed above involve portable devices. If utilized in these locations they are subject theft, abuse and misuse. The danger of electrical shock dictates against the use of such portable devices in the bathroom, which is the area most convenient for washing and therefore drying clothing. While a proprietor may not able to control devices brought into the room by the guest, he must be certain that any device which he supplies meets the astringent safety requirements established for such establishment. Furthermore, in view of the constant danger of fire in these establishments, great care must be taken to see that devices provided by the establishment meet the astringent fire safety requirements that apply to these establishments.

In addition, many older establishments may not have adequate electrical service at a location convenient for using the garment dryer. These establishments tend to be of heavy construction in order to meet fire safety laws and provide quite. Adding additional electrical service under these conditions can be an expensive and time-consuming task.

The devices shown in Harvey, Stainbrook and Turner are self contained dryers that have their own motor and heating element. Therefore, they would have to meet the astringent fire and electrical safety requirements for such devices when utilized in hotels and similar establishments. This necessarily increases their cost and delays their introduction due to the long testing process which may be encountered before safety approval is granted. Furthermore, because these devices are portable and are likely to be utilized in bathroom where contact with water and plumbing poses extreme electrical safety hazards, special safety features need be incorporated in these devices. In addition, special safety devices need be incorporated to protect the unit against fire should there be a malfunction in the device or should the device overheat for some reason.

Devices such as that shown in Hansen et al, Buchanan, Muller-Scherak, Hubner and Brahm dry the garment in a static position. Accordingly, it is likely that one portion of the garment will be dry while other portions of the garment will remain wet. The Hansen et al, Buchanan and Muller-Scherak devices require constant supervision as they are powered by portable hand-held hair dryers which cannot or should not be left unattended. The bags or cardboard container utilized in these devices pose a fire hazard should they become over-heated during use and either be set afire or for the bags, melt. In any event, all of these devices do not have the durability for utilization in an establishment such as a hotel where they will be constantly in use. Again, it is undesirable for the proprietor of the establishment to give out devices which encourage the utilization of portable hair dryer or the like, which hair dryers are not provided with the safety aspects described above.

SUMMARY OF THE INVENTION

It is a general object of the present invention to provide a tumble dryer for drying small articles of clothing.

Another object of the invention is to provide a tumble dryer having no motor or heater means therein.

A further object of the invention is to provide a tumble dryer which can be safely left unattended without having safety devices therein.

Yet another object of the invention is to provide a tumble dryer usable with a wall-mounted hair dryer.

These and other objects, advantages and features are achieved by a tumble dryer for small articles of clothing comprising:

(a) a housing for mounting on a surface adjacent a hair dryer mounted on said surface;

(b) a drum rotatably mounted within said housing, and having air vents on a periphery thereof;

(c) turbine means mounted on said periphery of said drum;

(d) inlet means in said housing for receiving an outlet from a hair dryer mounted adjacent to said housing, said outlet providing a source of warm air under pressure, and for directing said pressurized air against said turbine means to rotate said drum;

(e) vent means in said housing for venting said pressurized air to the atmosphere after drying clothing in said drum.

DETAILED DESCRIPTION OF A PREFERRED EMBODIMENT

Figure 1:
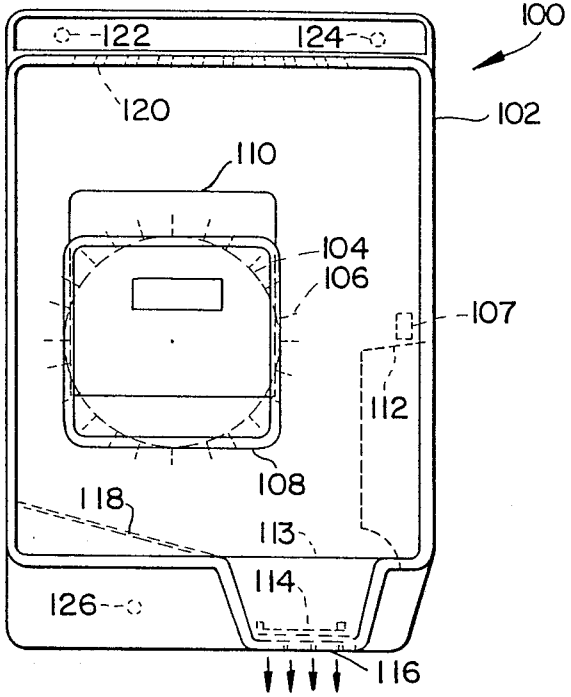
FIG. 1 is a front view of the tumble dryer in accordance with the present invention.

Referring to FIG. 1, a tumble dryer in accordance with the present invention is generally shown as 100. The tumble dryer comprises a housing 102 which can be mounted to a wall or other vertical surface by means of screws or other mounting devices 122, 124 and 126. The housing contains a drum 104 which is rotatably mounted within the housing by means not shown. The drum has air vents along its periphery to permit air to flow therethrough. The air vents can be provided by forming the drum of a light weight aluminum or stainless steel mesh, for example. Mounted on the periphery of the drum are a plurality of turbine blades 106. The housing 102 has an opening 108 at the open end of the drum which allows clothing to be placed in the drum for drying. This opening 108 is covered by a sliding door 110 which is shown halfway open and halfway closed in FIG. 1. As would be obvious to one skilled in the art, the door 110 could also be a hinged door and could be hinged from either side, the top or the bottom and be provided with a suitable latch.

The housing 102 has a cradle 112 for holding an outlet handle of a wall-mounted hair dryer which is not shown in FIG. 1. The outlet handle is shown attached to the box in FIG. 2 and the cradle is shown in greater detail in FIG. 3, both of which are described below.

The bottom of the housing 102 contains a recess 113 which is adjacent a sloping drainage board 118. Water that may drip from wet clothing inserted into the drum 104 will be directed by the sloping drainage board 118 into the recess 113. The recess 113 may be provided with a tray 114 for catching this water. The tray 114 may, as an optional feature, be removable to allow warm air to exist from the vent 116 for drying one's hands.

The top of the housing 102 contains a plurality of vents 120 which permits warm air which has passed over and helped dry clothing inserted into the drum 104 to escape to the atmosphere.

The housing 102 is preferably molded of a heat resistent plastic. The utilization of a molded plastic housing permits the molding of ridges at the front and back of the housing to rotatably support the drum 104.

The tumble dryer as shown is simple and inexpensive to manufacture because it contains no complex moving parts, and no motor or heater means of any kind. Therefore, it is does not need to meet the stringent electrical safety requirements that would be imposed upon a dryer having an electric heater and an electric motor for rotating the drum and turning a fan to provide a forced warm air flow. Because the heat source is external, no thermal safety devices are required for the tumble dryer.

Figure 2:
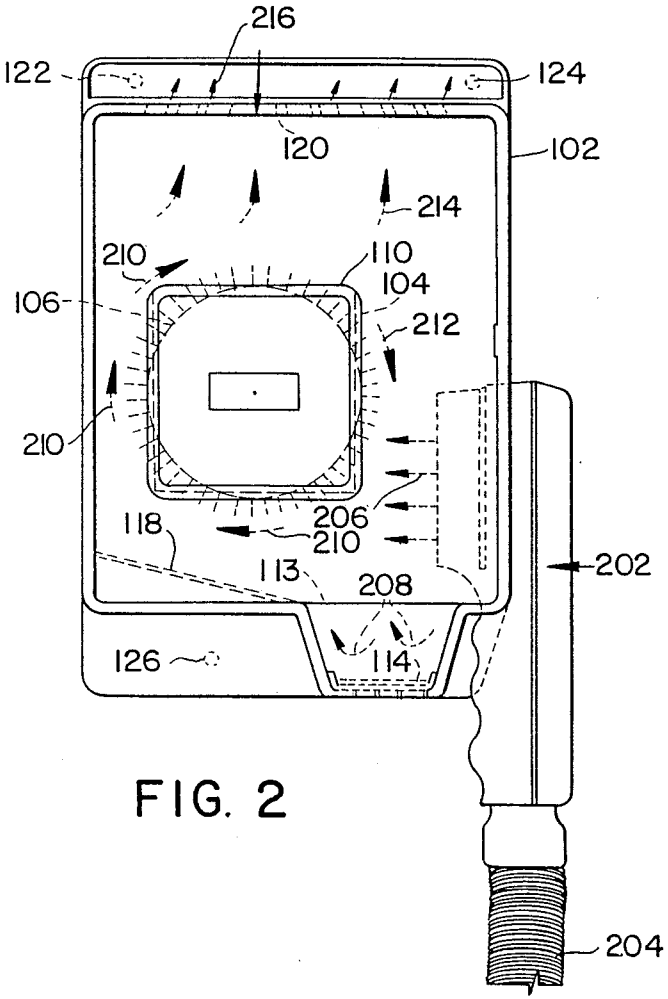
FIG. 2 shows the tumble dryer of FIG. 1 connected to the output of a hair dryer, the hair dryer itself not being shown.

Referring to FIG. 2, the tumble dryer is illustrated in use with the outlet of a wall-mounted hair dryer. Like components of FIG. 1 are denoted by the same reference numerals. In FIG. 2 the outlet handle 202 of a wall-mounted hair dryer (not shown) is inserted into the cradle 112 of the housing 102. The hair dryer is turned on and warm air under pressure is delivered via hose 204 to the outlet handle 202. The outlet handle 202 is mounted in the cradle 112 so that the air flow from the hair dryer is directed as shown by arrows 206 The cradle 112 is below the horizontal axis of the drum so that the directed air flow contacts turbine blades 106. The turbine blades are angled with respect to the periphery of the drum 104 to cause the drum to rotate in the direction indicated by arrow 212. The warm air continues to follow the path indicated by arrows 210, some of the air passing through the clothing in the drum 104. The air then flows in the direction indicated by arrows 214 through vents 120 as indicated by arrows 216 to the atmosphere. During operation of the hair dryer, the door 110 is in the closed position, as shown in FIG. 2. This not only prevents the clothing from falling out of the drum as the drum rotates, but prevents the escape of hot air through the unclosed opening. In addition, the tray 114 should be inserted into its position to close off the vent 116 and cause the warm air to flow in the direction indicated by arrows 208. Otherwise, a portion of the warm air provided by the hair dryer will be lost to the hand dryer, this slowing the drying process. Furthermore, if the tray 114 is removed, water that drips from the clothes inserted into the drum 104, will be deflected by the sloped drainage board 118 through the vent 116 and onto the floor.

It should be noted, that the tumble dryer of the present invention is not a spin dryer. The turbine blades are designed to slowly rotate the drum in order to provide an even distribution of the heat and gently dry the clothes inserted into the drum.

Figure 3:
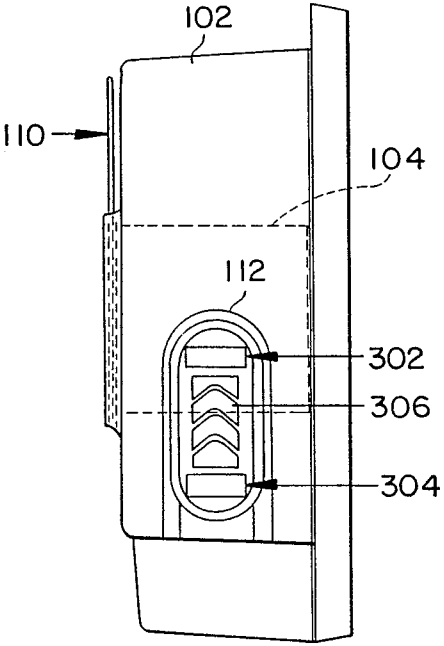
FIG. 3 is a side view of the tumble dryer showing the receptacle for the output of the hair dryer.

Referring to FIG. 3, the cradle 112 is shown in greater detail. As shown in FIG. 3, the cradle 112 has a shape which is complementary to that of the outlet handle 202. Although the outlet handle 202 shown in FIG. 2 has a right-angle exist, this is not necessary to practice the present invention. This is because the hose 204 can bend to accommodate an outlet handle in which the air exists along longitudinal direction of the hose. The cradle 112 includes two magnets 302, 304 which are attracted to a metal portion of the outlet handle 202 The metal portion can either be the front grill of the outlet handle or metal plates attached to the outlet handle to hold the outlet handle in the cradle in cooperation with magnets 302, 304. The cradle 112 has slots 306 which permits the air flowing out of the outlet handle 202 to enter the inside of the housing 102.

Figure 4:
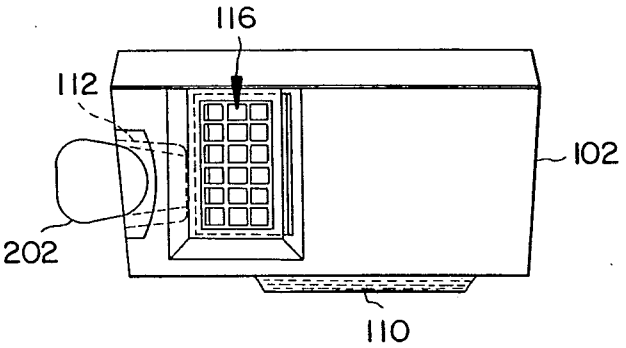
FIG. 4 is a bottom view of the tumble dryer showing the vents.

FIG. 4 illustrates a bottom view of the tumble dryer with the outlet handle 202 inserted into the cradle 112.

This figure illustrates the outlet vents 116. If it is desired to utilize the tumble dryer without the tray 114, a door (not shown) can be utilized to close off the vents 116 when the hand dryer is not in use. This door can either be a sliding door which could slide in the bottom of the housing from the right side of the housing to the left side of the housing (not shown) or a pivoting door (not shown).

Figure 5:
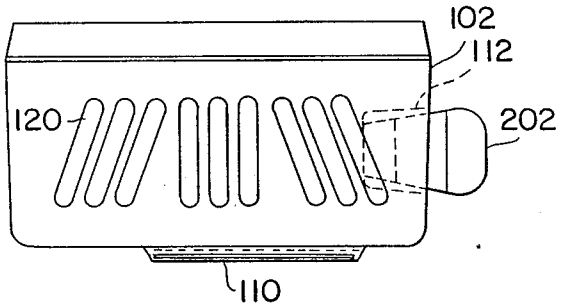
FIG. 5 is a top view of the tumble dryer showing the vents.

FIG. 5 illustrates a top elevation of the tumble dryer of the present invention in which the handle 202 is inserted in the cradle 112. Oblong vents 120 are shown at the top of the housing 102. It is not necessary that the vents be at the top of the housing, and other locations could be utilized provided they allow the air to escape after it has passed over the turbine blades and the garments in the drum.

Figure 6:
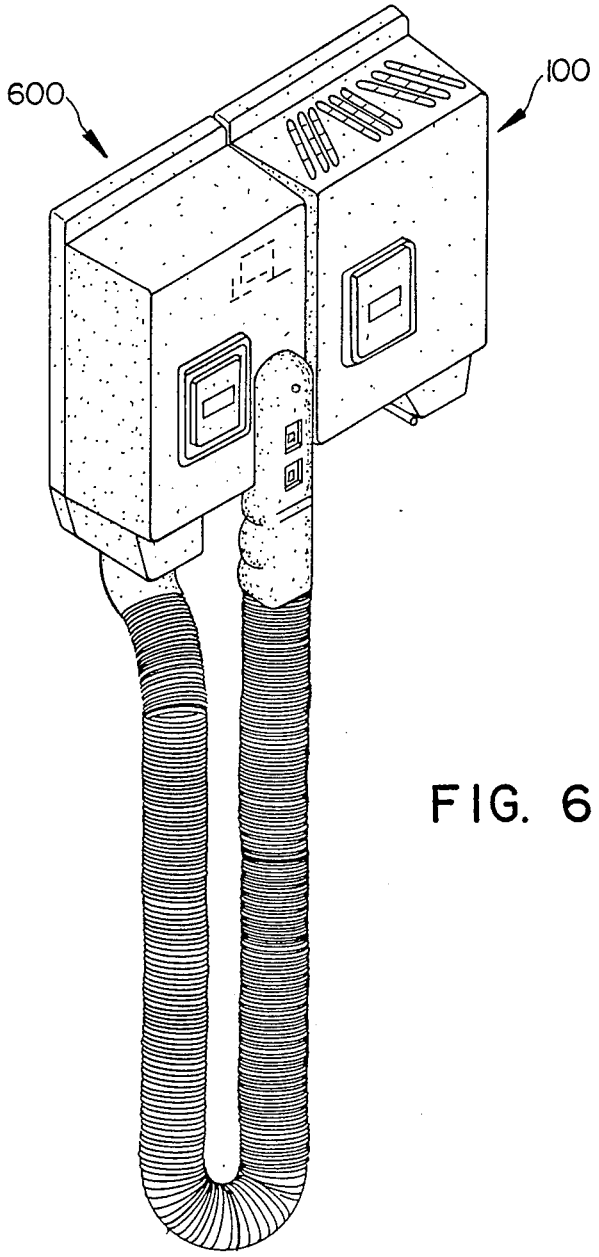
FIG. 6 shows the tumble dryer mounted on a wall next to a wall-mounted hair dryer.

FIG. 6 illustrates a typical combination of the tumble dryer 100 of the present invention with a wall-mounted hair dryer 600. The tumble dryer is attached to one side of the wall-mounted hair dryer by means of clips, for example. The wall-mounted hair dryer 600 is preferably of the type disclosed in U.S. Pat. No. 4,700,049 which issued on Oct. 13, 1987 to the inventor of the present invention and which is incorporated herein by reference. This hair dryer is automatically activated when the outlet handle 202 is removed from a cradle 712 (see FIG. 7) in the housing 702. The dryer remains on as long as the handle is removed from the cradle until a predetermined period of time has elapsed, at which it automatically shuts off. Therefore, problems associated with the unattended operation of the hair dryer, such as fires, are eliminated. Thus, if the handle 202 is removed from the hair dryer 600 and inserted into the cradle 112 of the tumble dryer 100, warm air would be supplied to the tumble dryer for a predetermined period of time, after which the hair dryer will shut off. This allows unattended drying of the clothes in the tumble dryer without the fire hazard which could be present if the dryer ran continuously. All of the electrical and fire safety requirements are met by the wall-mounted hair dryer, thus obviating the need to meet these requirements in the tumble dryer. The wall-mounted hair dryer is approved for use in hotels and similar establishments including use in the bathrooms thereof, thus allowing the tumble dryer to be provided in a bathroom, which is the location most convenient for the guest.

Figure 7:
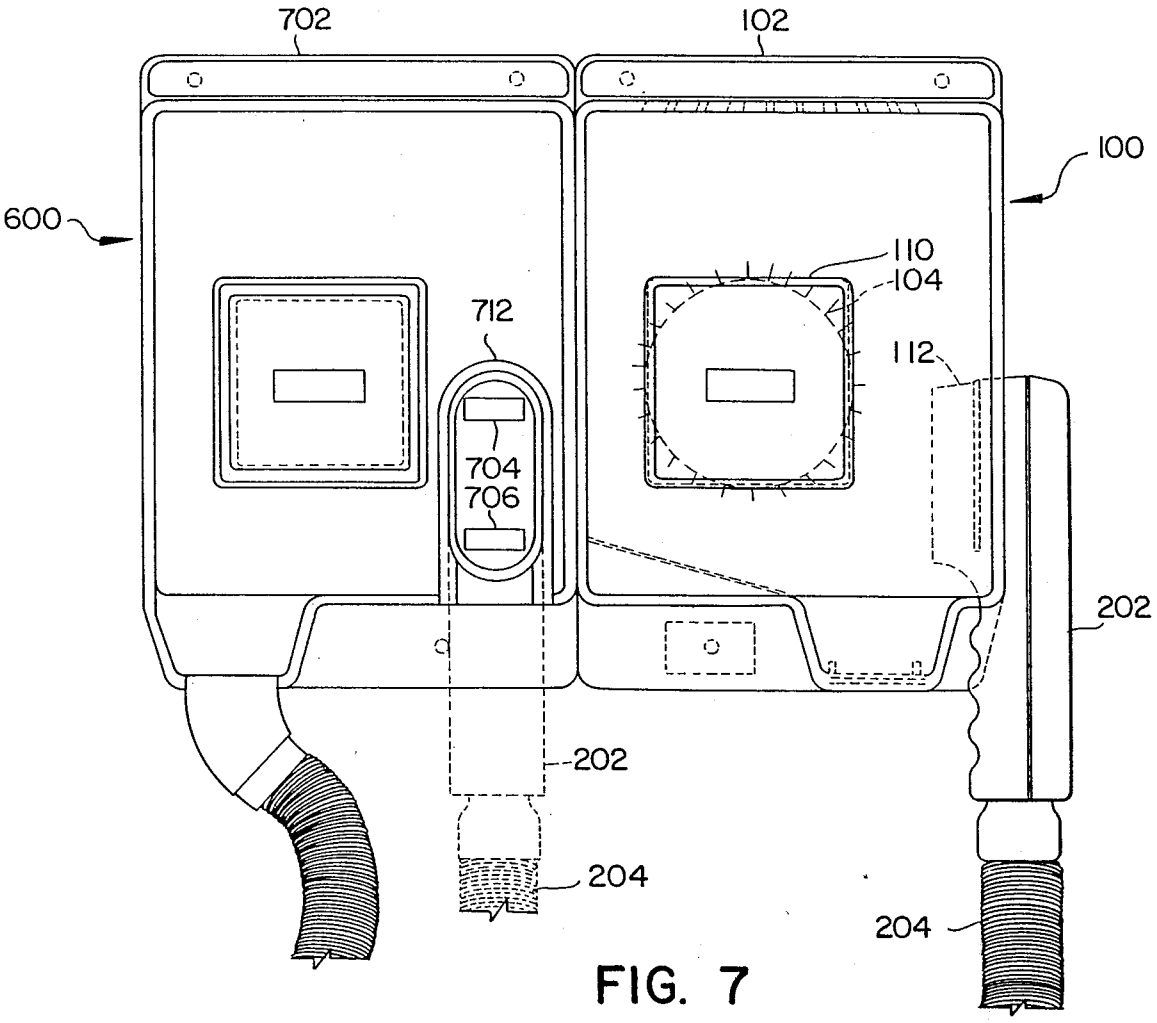
FIG. 7 shows the combination shown in FIG. 6 in operation.

As shown in FIG. 7, the handle 202 is retained in the cradle 112 of the wall-mounted hair dryer 600 by magnet 704 and 706 which are in a similar position to magnets 302 and 304 in cradle 112. In addition, as shown, the housings of the wall-mounted hair dryer 600 and the tumble dryer 100 can be made similar in appearance and of the same heat-resistant plastic material. A micro switch 107 (FIG. 1 is utilized to reduce the amount of heat produced by the heating element (not shown) of the hair dryer by means not illustrated. The utilization of a switch to provide a hair dryer with a plurality of heater settings is well known and need not be described in detail here. The reduction in the heat produced by the hair dryer has been found to produce the correct temperature for drying of clothing.

While a particular embodiment of the present invention has been disclosed herein, certain changes and modifications will readily occur to one skilled in the art. All such changes and modifications can be made without departing from the invention as defined by the appended claims.

I claim:

1. A tumble dryer for small articles of clothing comprising:

(a) a housing for mounting on a surface adjacent a hair dryer mounted on said surface;

(b) a drum rotatably mounted within said housing, and having air vents on a periphery thereof;

(c) turbine means mounted on said periphery of said drum;

(d) inlet means in said housing for receiving an outlet from a hair dryer mounted adjacent to said housing, said outlet providing a source of warm air under pressure, and for directing said pressurized air against said turbine means to rotate said drum;

(e) vent means in said housing for venting said pressurized air to the atmosphere after drying clothing in said drum.

2. The tumble dryer according to claim 1 wherein said turbine means comprises a plurality of turbine blades.

3. The tumble dryer according to claim 2 further comprising a door on a front of said housing for retaining clothing in said drum and wherein said vent means comprises vent holes in said housing.

4. The tumble dryer according to claim 3 wherein said drum is rotatably supported by ridges molded into said housing.

5. The tumble dryer according to claim 1 further comprising a tray in said housing, said tray being removable to allow said warm air to escape from said housing whereby said dryer can be used to dry hands or warm a room.

6. The tumble dryer of claim 5 wherein said tray is located below said drum when said housing is mounted on a wall whereby water dripping from wet clothing in said drum is collected in said tray.

7. The tumble dryer according to claim 1 wherein said surface is a wall.

* * * * *